US008950901B2

(12) United States Patent
Moreau et al.

(10) Patent No.: US 8,950,901 B2
(45) Date of Patent: Feb. 10, 2015

(54) LIGHTING ASSEMBLY AND METHODS OF ASSEMBLING SAME

(75) Inventors: Nicolas Moreau, Ringwood North (AU); Aurelien Ray, Upwey (AU); Jeremy Kumin, Durham, NC (US)

(73) Assignee: Enttec Pty Ltd. (AU)

( * ) Notice: Subject to any disclaimer, the term of this patent is extended or adjusted under 35 U.S.C. 154(b) by 185 days.

(21) Appl. No.: 13/571,822

(22) Filed: Aug. 10, 2012

(65) Prior Publication Data

US 2014/0043812 A1 Feb. 13, 2014

(51) Int. Cl.
*F21V 29/00* (2006.01)

(52) U.S. Cl.
USPC ..... 362/294; 362/218; 362/235; 362/373

(58) Field of Classification Search
CPC ..... F21V 29/2293; F21V 5/04; F21V 29/22; F21V 29/2206; F21V 29/00; F21V 5/007; F21V 23/06; G09F 9/33; H05K 1/00
USPC ..... 362/84, 218, 294, 249.02, 235, 373, 362/335
See application file for complete search history.

(56) References Cited

U.S. PATENT DOCUMENTS

2012/0182713 A1* 7/2012 Bretschneider ..... 362/84
2012/0300456 A1* 11/2012 Phillips et al. ..... 362/245
2014/0126214 A1* 5/2014 Gebhard et al. ..... 362/294

* cited by examiner

*Primary Examiner* — Anh Mai
*Assistant Examiner* — Kevin Quarterman
(74) *Attorney, Agent, or Firm* — Mayback & Hoffman, P.A.; Gregory L. Mayback; Thomas Bethea

(57) ABSTRACT

A lighting assembly is disclosed. The lighting assembly has an extrusion having a back plate and a plurality of fins. Each fin has a plurality of openings. The lighting assembly has at least one circuit board with a plurality of LEDs. The lighting assembly also has at least one lens holder. Each lens holder has a plurality of openings and a plurality of pockets. The plurality of openings of the lens holder are disposed to accommodate the plurality of LEDs when the lens holder is placed on top of the circuit board. Each of the plurality of pockets is used to accommodate placement of a corresponding lens. The plurality of LEDs are disposed, and the corresponding lenses are sized and disposed, to maximize light density over a given area.

12 Claims, 7 Drawing Sheets

205
215

107
225
150
142
220

210

215

250
270
275
255
260
265

205
107
150
142
250
210
255

235
245
230
240

Processor Chip → MASTER 535
NO Processor Chip → SLAVE 540

3 components → JUNIOR 545
6 components → HIGH POWER 550

115
530
SLAVE PCB
520
525
105
555
145
505
510
515
560

LIGHTING ASSEMBLY AND METHODS OF ASSEMBLING SAME

FIELD OF THE INVENTION

The present invention lies in the field of lighting assemblies. The present disclosure relates to optical arrangements for and heat dissipation of lighting assemblies, in particular, light emitting diode (LED) lighting assemblies.

BACKGROUND OF THE INVENTION

In the world of light emitting diode fixtures for entertainment and architectural applications, there exist many form factors, as there are with conventional tungsten-lamp based luminaires and other sources of artificial light. One of the most prevalent light sources for certain usages has traditionally been what is referred to as a light bar, because a light bar configuration allows a linear arrangement of fixtures to be deployed easily from one physical location to another, such as on a pipe or at an edge of a stage, or on a floor in a line for purposes of washing a backdrop with light.

Several constraints operate on light bars to limit what they can do and to demand that they do certain things well. Some of the most important factors for typical users include:

- maximum brightness, which is desirable to enable an LED to compete with the traditional quartz-halogen-equipped style of strip lighting;
- minimum space and power consumption, which are also desirable because space is often at a premium in a crowded theater, television studio, and the like; and
- weight, which affects the ability of the fixture to tour conveniently as well as ease of installation.

Fixtures that have taken the LED idea and applied it to a linear "light bar" format in the past have gone several routes, some of which include:

- using a very large number of small low-power LEDs: This allows for a small form factor but limits the overall brightness tremendously. Alternatively, this configuration allows for high brightness at the expense of compactness;
- using high-power tricolor LEDs: These are expensive and have a limited color gamut. These LEDs cannot be mixed with as much subtlety of color rendering as a more varied combination of wavelengths allows; and
- using high power LEDs and mixing their colors after the diode, or after some optical train elements: This configuration allows for greater color options and a better light output but takes up more space than the alternatives and therefore is not ideal for a small footprint. Also, manufacturers using this technique commonly use diffusion media (holographic film or other kinds of frosted filters) to blend the colors and to widen the beam angle produced by the LEDs. This method is flexible for in-the-field adjustments but it cannot give a user different optical properties for each of the colors being mixed, should that be desired.

Thus, a need exists to overcome the problems with the prior art systems, designs, and processes as discussed above.

SUMMARY OF THE INVENTION

The invention provides a lighting assembly and methods of assembling the lighting assembly that overcome the hereinafore-mentioned disadvantages of the heretofore-known devices and methods of this general type and that provide such features by maximizing light density over a given area with an efficient, modular form and with improved heat dissipation.

With the foregoing and other objects in view, there is provided, in accordance with one exemplary embodiment, a lighting assembly. The lighting assembly comprises an extrusion having a back plate and a plurality of fins. Each fin has a plurality of openings. The lighting assembly has at least one circuit board with a plurality of LEDs. The lighting assembly also has at least one lens holder. Each lens holder has a plurality of openings and a plurality of pockets. The plurality of openings of the lens holder are disposed to accommodate the plurality of LEDs when the lens holder is placed on top of the circuit board. Each of the plurality of pockets is used to accommodate placement of a corresponding lens. The plurality of LEDs are disposed, and the corresponding lenses are sized and disposed, to maximize light density over a given area.

In accordance with a further feature of the invention, the plurality of fins comprise top fins and bottom fins.

In accordance with an added feature of the invention, the plurality of fins allow heat to dissipate over multiple axes.

In accordance with an additional feature of the invention, the back plate comprises a heat sink.

In accordance with yet another feature of the invention, the back plate has a plurality of openings.

In accordance with yet a further feature of the invention, the plurality of openings of the back plate comprise a first type of opening that allows the at least one circuit board to be connected to a control printed circuit board (PCB).

In accordance with yet an added feature of the invention, the at least one circuit board is connected to the control PCB using an electrical connector surface mounted on the PCB.

In accordance with yet an additional feature of the invention, the plurality of openings of the back plate comprises a second type of opening that is used to attach the at least one circuit board and the at least one lens holder to the back plate.

In accordance with again another feature of the invention, side plates are attached to each side of the extrusion.

In accordance with again a further feature of the invention, the side plates are ruggedized to reinforce against vibration and shock.

In accordance with again an added feature of the invention, the extrusion comprises a male connector and a female connector.

In accordance with a concomitant feature of the invention, the male connector and female connector allow for serial connection to other lighting assemblies.

Although the invention is illustrated and described herein as embodied in a lighting assembly, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Additional advantages and other features characteristic of the present invention will be set forth in the detailed description that follows and may be apparent from the detailed description or may be learned by practice of exemplary embodiments of the invention. Still other advantages of the invention may be realized by any of the instrumentalities, methods, or combinations particularly pointed out in the claims.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward.

BRIEF DESCRIPTION OF THE DRAWINGS

The accompanying figures, where like reference numerals refer to identical or functionally similar elements throughout the separate views, which are not true to scale, and which, together with the detailed description below, are incorporated in and form part of the specification, serve to illustrate further various embodiments and to explain various principles and advantages all in accordance with the present invention. Advantages of embodiments of the present invention will be apparent from the following detailed description of the exemplary embodiments thereof, which description should be considered in conjunction with the accompanying drawings in which:

FIG. 7A is a perspective view of an indoor side plate according to one exemplary embodiment;

FIG. 7B is a perspective view of an outdoor side plate according to one exemplary embodiment;

FIG. 7C is a perspective view of a ruggedized side plate according to one exemplary embodiment;

DETAILED DESCRIPTION OF THE INVENTION

Figure 1:
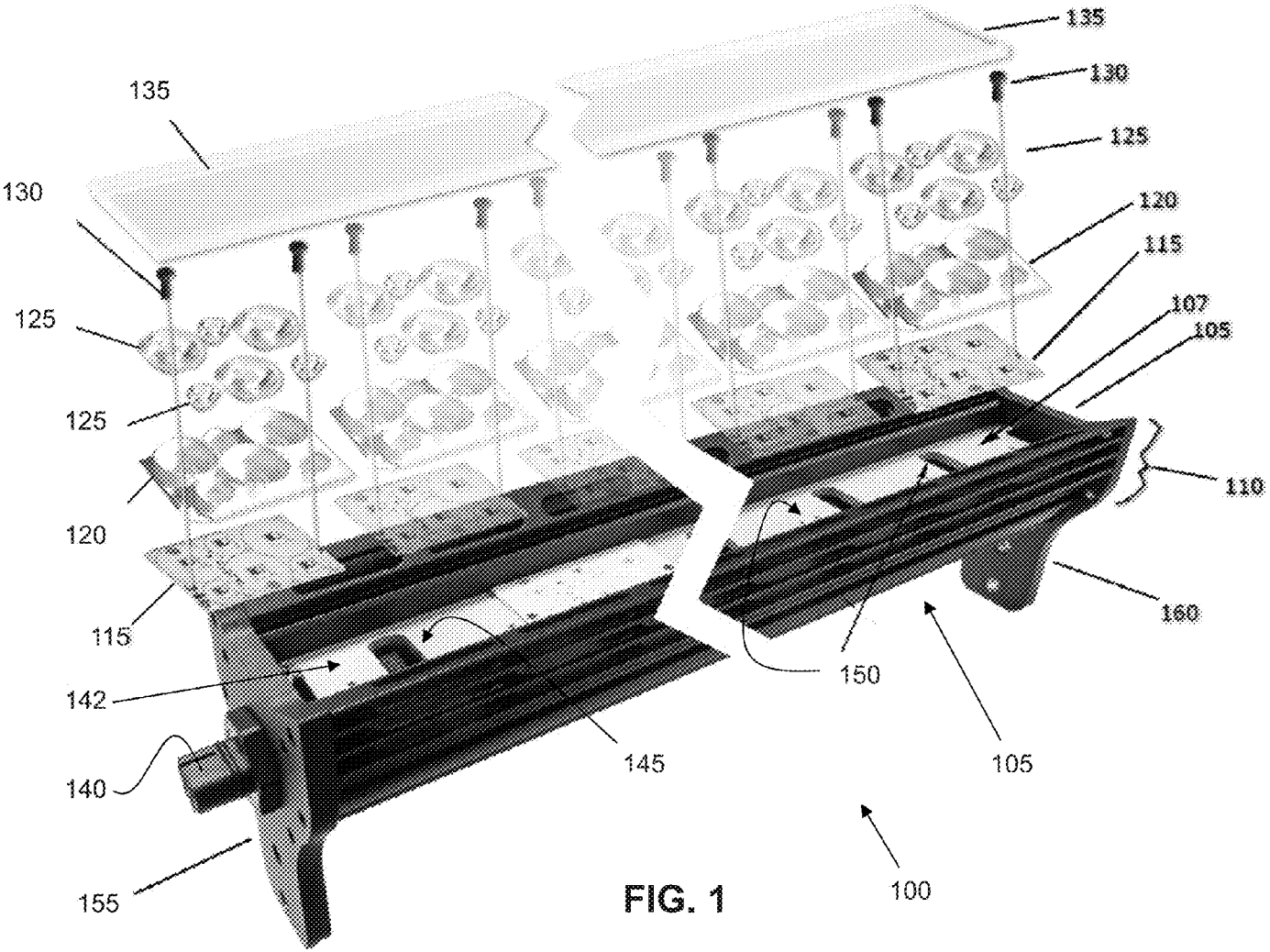
FIG. 1 is an exploded perspective view of lighting assembly 100, according to one embodiment.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward.

Alternate embodiments may be devised without departing from the spirit or the scope of the invention. Additionally, well-known elements of exemplary embodiments of the invention will not be described in detail or will be omitted so as not to obscure the relevant details of the invention.

Before the present invention is disclosed and described, it is to be understood that the terminology used herein is for the purpose of describing particular embodiments only and is not intended to be limiting. The terms "a" or "an", as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically.

Relational terms such as first and second, top and bottom, and the like may be used solely to distinguish one entity or action from another entity or action without necessarily requiring or implying any actual such relationship or order between such entities or actions. The terms "comprises," "comprising," or any other variation thereof are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

As used herein, the term "about" or "approximately" applies to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure.

Herein various embodiments of the present invention are described. In many of the different embodiments, features are similar. Therefore, to avoid redundancy, repetitive description of these similar features may not be made in some circumstances. It shall be understood, however, that description of a first-appearing feature applies to the later described similar feature and each respective description, therefore, is to be incorporated therein without such repetition.

Described now are exemplary embodiments of the present invention. Referring now to the figures of the drawings in detail and first, particularly to FIG. 1, there is shown a first exemplary embodiment of an exploded perspective view of a lighting assembly 100. Lighting assembly 100 includes an extrusion 105. Extrusion 105 has a back plate 107 and a plurality of fins 110. Lighting assembly 100 may also include side plates 155, 160 attached to extrusion 105. Back plate 107 has a plurality of openings. Back plate 107 may also act as a heat sink. One type of opening on back plate 107 is an opening 142 for an electrical connector 145. The electrical connector 145 is used to couple circuit board 115 to another circuit board (not shown on this figure) that provides power to circuit board 115. Another type of opening 150 is used to receive connectors 130. In one exemplary embodiment, connectors 130 may be screws. Circuit board 115 is placed on back plate 107. Circuit board 115 has connected thereon a plurality of light emitting diodes (LEDs). Lens holder 120 is placed over circuit board 115. Connectors 130 are used to connect the circuit board 115 and lens holder 120 to back plate 107. Lens holder 120 has openings corresponding to the LEDs on circuit board 115. The lens holder 120 is shaped to have pockets above and surrounding each LED opening to accommodate placement of a lens 125 into each pocket. The LEDs, pockets, and lenses are sized and disposed to maximize light density over a given area. Male connector 140 is used to modularly connect extrusions together via a corresponding female connector (not shown on this figure but, in an exemplary configuration, present on the right side of the side plate 160 in FIG. 1).

The present invention improves upon the placement of LEDs on a circuit board to allow more LEDs to fit in a smaller area. The circuit board 115 may have different colored LEDs attached thereto. The lens holder 120 also allows for an end-user to designate differently-angled lenses for each of the colors, if necessary. The lens holder 120, in one exemplary embodiment, contains three pockets for larger lenses (which can, for example, collimate the beam produced by the LED to as small as 10°) and three pockets that hold slightly less tightly focused lenses (their smallest being a 25° spread, for example). By staggering the larger and smaller pockets in a zig-zag fashion, a greater efficiency is achieved, producing a smaller footprint for the overall fixture than previous designs would have using similar numbers of LEDs.

In one embodiment, there are no lenses in front of the LEDs. Since there are no lenses in this embodiment, a lens holder is not required. In this embodiment, an approximately 120° light spread is achievable.

Figures 2A, 2B, 2C, 2D, 2E, 2F, 3:
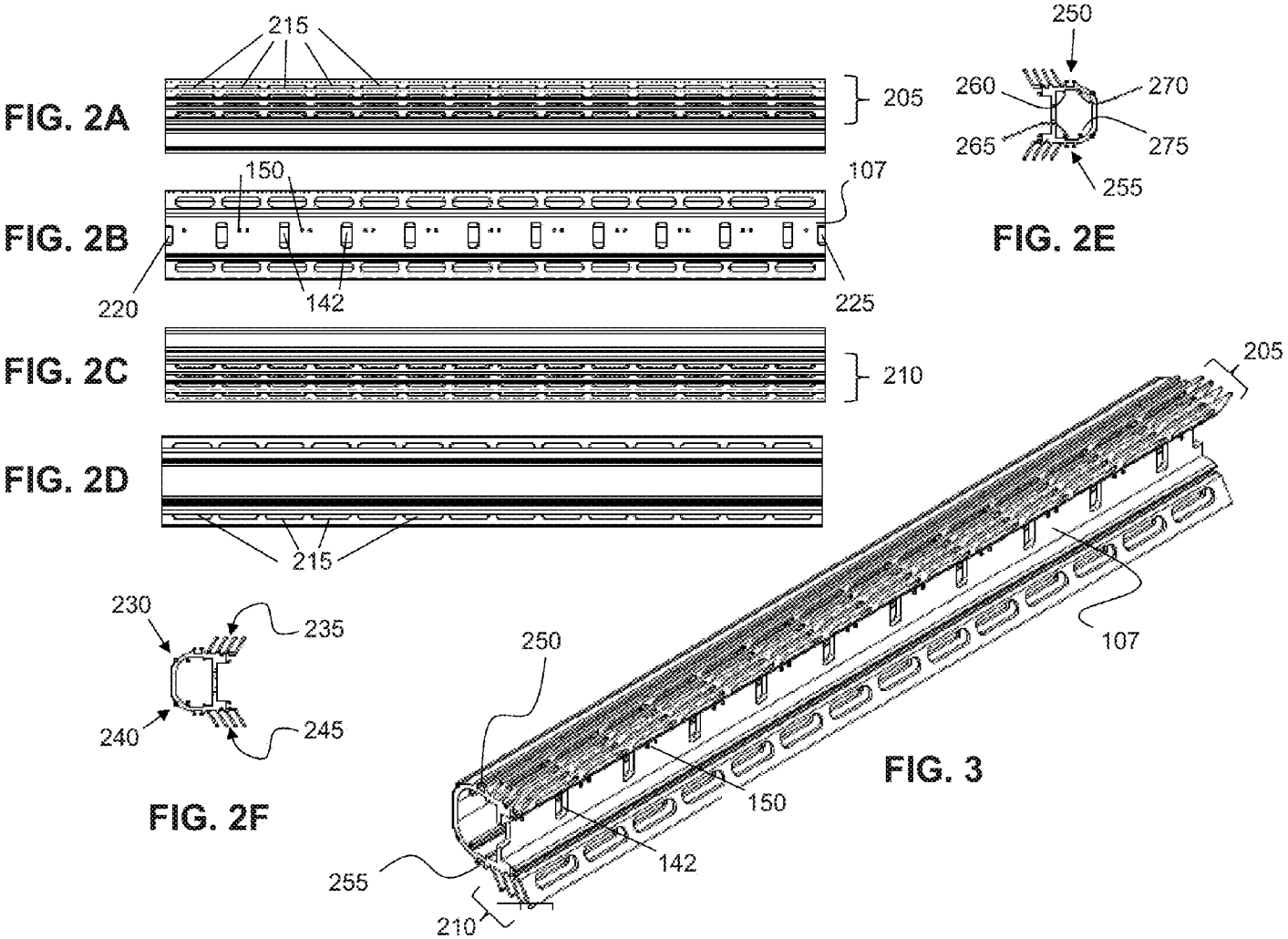
FIG. 2A is a top elevational view of the extrusion of FIG. 1.
FIG. 2B is a front elevational view of the extrusion of FIG. 1.
FIG. 2C is a bottom elevational view of the extrusion of FIG. 1.
FIG. 2D is a rear elevational view of the extrusion of FIG. 1.
FIG. 2E is a right side elevational view of the extrusion of FIG. 1.
FIG. 2F is a left side elevational view of the extrusion of FIG. 1.
FIG. 3 is a perspective view of the extrusion of FIG. 1.

FIGS. 2A-2F illustrate extrusion 105 according to one embodiment. FIGS. 2A and 2C illustrate top and bottom views, respectively, of extrusion 105. FIG. 2A illustrates top fins 205 and FIG. 2C illustrates bottom fins 210. Each one of the plurality of fins 205, 210 has a plurality of openings 215. The configuration of the plurality of fins and the number and size of the plurality of openings on each fin are configured in a manner that improves heat dissipation.

FIG. 2B illustrates a front view of extrusion 105 according to the exemplary embodiment. FIG. 2B shows fins 205, 210 and back plate 107. Back plate 107 has openings 142, 150. As described in FIG. 1, opening 142 is used for electrical connector 145 and opening 150 is used to receive connector 130. FIG. 2B also shows openings 220, 225. Openings 220, 225 facilitate connection of a grounding wire to the chassis, e.g., extrusion 105, as it passes through one or more of these holes.

FIG. 2D illustrates a back or rear view of extrusion 105 according to the embodiment. FIG. 2D shows fins 205, 210 and openings 215.

FIGS. 2E and 2F illustrate side views of extrusion 105 according to the embodiment. FIG. 2E shows groove 250 and groove 255. Groove 250 and groove 255 allow for attachment of accessories, such as a power supply or items that might influence the shape of the light output such as egg-crating, "barn doors", etc. FIG. 2F shows grooves 230, 235, 240, 245. Each of these grooves runs longitudinally (left-right in FIGS. 2A-2D) along extrusion 105. Grooves 230, 235, 240, 245 are used to attach side plates 155, 160 to extrusion 105 using a connector. In one exemplary embodiment, the connector attaching side plates 155, 160 to extrusion 105 is a screw.

There are ridges 260, 265 inside the chamber of extrusion 105. These ridges 260, 265 facilitate the positioning of at least one PCB to nestle up to the rear of back plate 107 close enough to make electrical connection to 115, but not too close so as to short out against the back plate or crush components on the PCB. There are also a second pair of extruded ridges 270, 275 to push against the at least one PCB with rods in order to hold the PCB tightly up against ridges 260, 265.

In one exemplary embodiment of the extrusion 105, the extrusion 105 is extruded with fins and then is re-machined to include vertical slots, e.g., openings 215, therein so that heat dissipation is improved. This improvement, confirmed through thermal modeling and tests, measured an approximately 20% increase in dissipation efficiency over a similar fin design that is not pierced. Using a configuration that includes vertical slots provides a significant improvement over designs with un-pierced fins due to the fact that, when the assembly is deployed in a horizontal fashion with the fins pointed down, heat may be trapped due to a lack of airflow between un-pierced fins. Other hanging orientations also show improvement due to the increased air circulation allowing heat transfer to occur faster. Typically, extrusions only dissipate effectively in one axis. However, because the orientation for a given installation or application of an LED light is unpredictable, the extrusion 105 allows heat to dissipate effectively over multiple axes.

FIG. 3 illustrates a perspective view of extrusion 105. Extrusion 105 has a back plate 107 and a plurality of fins 205, 210. Each of the plurality of fins 205, 210 has the plurality of openings 215. Back plate 107 also has a plurality of openings. One type of opening on back plate 107 is opening 142, which is an opening for electrical connector 145 (not shown). Another type of opening 150 is used to receive connectors 130. Connectors 130 are used to attach circuit board 115 and lens holder 120 to back plate 107. Grooves 230, 235, 240, 245 run longitudinally along extrusion 105 and are used to attach side plates 155, 160 to extrusion 105 using a connector. In the exemplary embodiment, the connector attaching side plates 155, 160 to extrusion 105 is a screw. Groove 250 and groove 255 are also shown in FIG. 3. Groove 250 and groove 255 allow for attachment of accessories, such as a power supply or items that might influence the shape of the light output such as egg-crating, "barn doors", etc.

Figure 4B:
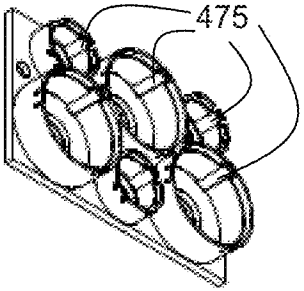
FIG. 4B is a perspective view of the lens holder of FIG. 1.
Figure 4D:
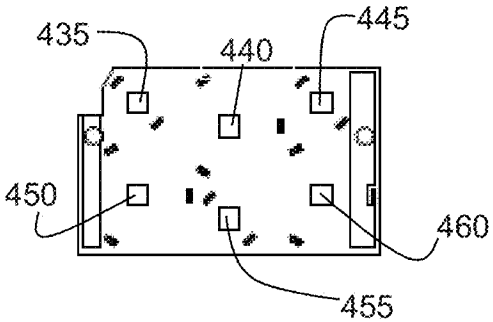
FIG. 4D is a rear view of the lens holder of FIG. 1.
Figure 4H:
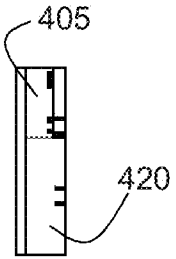
FIG. 4H is a left side elevational view of the lens holder of FIG. 1.
Figure 4C:
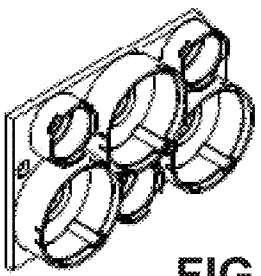
FIG. 4C is a perspective view of the lens holder of FIG. 1.
Figure 4E:
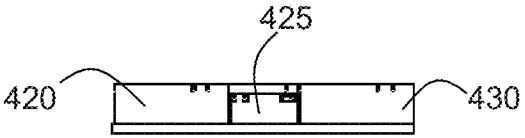
FIG. 4E is a bottom elevational view of the lens holder of FIG. 1.
Figure 4A:
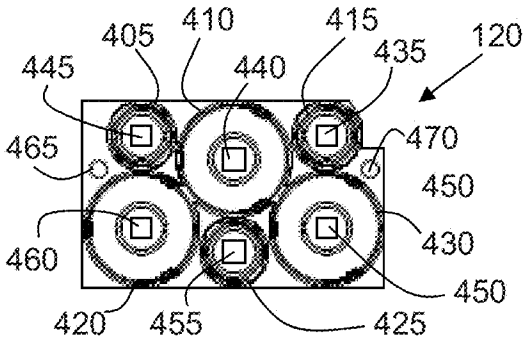
FIG. 4A is a front elevational view of the lens holder of FIG. 1.

FIGS. 4A-4H illustrate various views of lens holder 120 according to one exemplary embodiment. Lens holder 120 is configured to hold multiple lenses of different sizes in a compact footprint. FIG. 4A is a front view of lens holder 120. FIG. 4A shows pockets 405, 410, 415, 420, 425, 430. Also shown are openings 435, 440, 445, 450, 455, 460 shaped to be placed over LEDs on a circuit board (not shown in this figure; see, e.g., FIG. 1). The pockets are sized and disposed to maximize light density over a given area when used in conjunction with LEDs and lenses, e.g. lens 125, sized to fit each pocket. Also shown are openings 465, 470, which are used in conjunction with connector 130 to couple lens holder 120 to back plate 107.

FIGS. 4B and 4C illustrate perspective views of lens holder 120. Each pocket has a plurality of fasteners 475 used to hold a lens in place. In one embodiment, the plurality of fasteners are flexible clips. In one embodiment, each pocket has three flexible clips that are equidistantly spaced about the pocket and are used to hold the lens 125 in place.

FIG. 4D illustrates a back or rear view of lens holder 120. This view shows openings 435, 440, 445, 450, 455, 460. This side of lens holder 120 is placed on top of a circuit board, e.g. circuit board 115, having LEDs. The LEDs of the circuit board fit within openings 435, 440, 445, 450, 455, 460 when the lens holder 120 is placed on top of the circuit board.

Figure 4F:
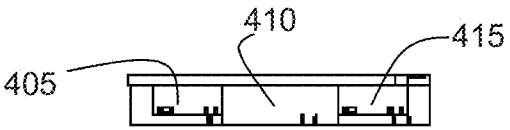
FIG. 4F is a top elevational view of the lens holder of FIG. 1.
Figure 4G:
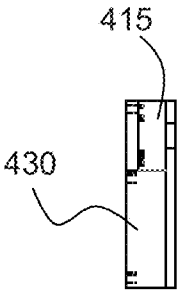
FIG. 4G is a right side elevational view of the lens holder of FIG. 1.

FIG. 4E is a bottom view of lens holder 120 and shows external surfaces corresponding to pockets 420, 425, 430. FIG. 4F is a bottom view of lens holder 120 and shows external surfaces corresponding to pockets 405, 410, 415. FIG. 4G is a side view of lens holder 120 and shows external surfaces corresponding to pockets 415, 430. FIG. 4H is a side view of lens holder 120 and shows external surfaces corresponding to pockets 405, 420.

Figures 5A, 5B, 5C, 5D, 5E, 5F:
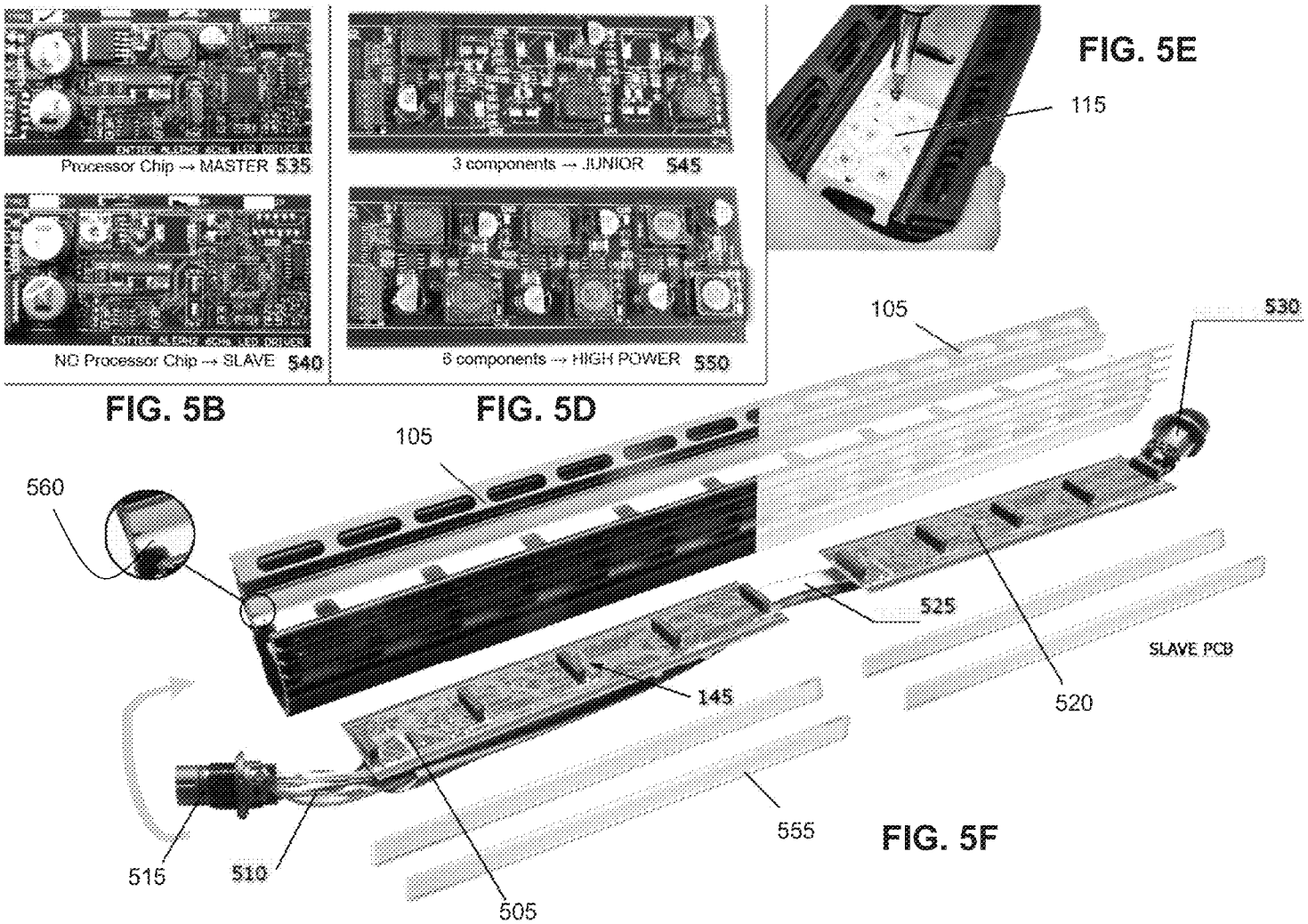
FIG. 5A is a top elevational view of a master printed circuit board according to one exemplary embodiment.
FIG. 5B is a top elevational view of a slave printed circuit board according to one exemplary embodiment.
FIG. 5C is a top elevational view of a junior printed circuit board according to one exemplary embodiment.
FIG. 5D is a top elevational view of a high power printed circuit board according to one exemplary embodiment.
FIG. 5E is a fragmentary, top perspective view of a portion of the lighting assembly of FIG. 1.
FIG. 5F is an exploded perspective view of printed circuit boards with the extrusion of FIG. 1 according to one exemplary embodiment.

FIGS. 5A-5F illustrate control printed circuit boards (PCBs) 505, 520 according to one exemplary embodiment. PCB 505 is coupled to male connector 515 via connection wires 510. In this configuration, PCB 505 is a master PCB that is connected to a slave PCB, e.g., PCB 520 via connector 525. Control PCBs 505, 520 have surface mounted thereon a plurality of electrical connectors, e.g. electrical connector 145. These connectors are used to provide power and control signals to LEDs of circuit boards, e.g., circuit board 115, coupled to the PCBs through the electrical connector. In one exemplary embodiment, PCBs 505, 520 provide power to circuit board 115 and may manipulate the direct current power supplied to achieve apparent levels of brightness. This manipulation of direct current power can be done with Pulse-Width Modulation in one exemplary embodiment. PCB 520 is coupled to a female connector 530. By using male and female connectors 515, 530, a lighting solution can be configured to be as long as necessary by serially plugging multiple lighting assemblies together. Separating functions using different circuit boards, e.g., PCB 505, 520 and circuit board 115, separated by back plate 107 helps to manage heat produced by these components more effectively. Although two PCBs are shown in FIG. 5F, it is possible to operate only one PCB, e.g. master PCB 505, placed within a shorter extrusion and having its own female connector.

There are ridges 260, 265 inside the chamber of extrusion 105. These ridges 260, 265 facilitate the positioning of the Master and Slave boards to nestle up to the rear of back plate 107 close enough to make electrical connection to 115, but not too close so as to short out against the back plate or crush components of the PCB. There are also a second pair of extruded ridges 270, 275 to push against PCB 505, 520 with rods 555 in order to hold PCB 505, 520 tightly up against ridges 260, 265.

Rods 555 are a particular shape that fit into a groove in a cavern inside extrusion 105. Rods 555 force PCBs (e.g., PCB 505, 520) up into a position where they mate fully with male connectors of circuit board 115. In one exemplary embodiment, rods 555 are plastic.

A process for inserting at least one PCB 505, 520 into an extrusion 105, according to one embodiment, begins with sliding PCB 505, 520 into the cavern of the extrusion. Electrical connectors 145 are then lined up to corresponding openings 142. Rods 555 are then pressed in behind the PCB(s) to elevate the PCB(s) up and into the space created by openings 142. Rods 555 elevate PCBs 505, 520 and lock them firmly into position.

Openings 220, 225 facilitate connection of a grounding wire to the chassis, e.g., extrusion 105, as it passes through one or more of these holes. In one embodiment, an opening 560 may also be used to facilitate connection of the grounding wire.

As stated above, the PCB can be either master 505, 535 or slave 520, 540. The difference between the master 535 and slave 540 is that the master has a processor chip and the slave does not. Master 505, 535 and slave 520, 540 PCBs can be implemented as either a junior version 545 or a high power version 550. Thus, the PCB can have four variants: master/junior, master/high power, slave/junior, and slave/high power. The high power option is used when 6 LEDs are present on circuit board 115. The junior option is used when there are 3 LEDs on circuit board 115. In junior implementations, the customer is able to save money and the lighting assembly requires less power.

All lighting assemblies need a master PCB, however, a slave is not always needed. If the length of a finished lighting assembly is nominally 300 mm, for example, only a master PCB needs to be inserted. If the lighting assembly is longer than 300 mm, for example 600 mm, one or more slave PCBs is inserted to fill up the extrusion 105.

Figure 6:
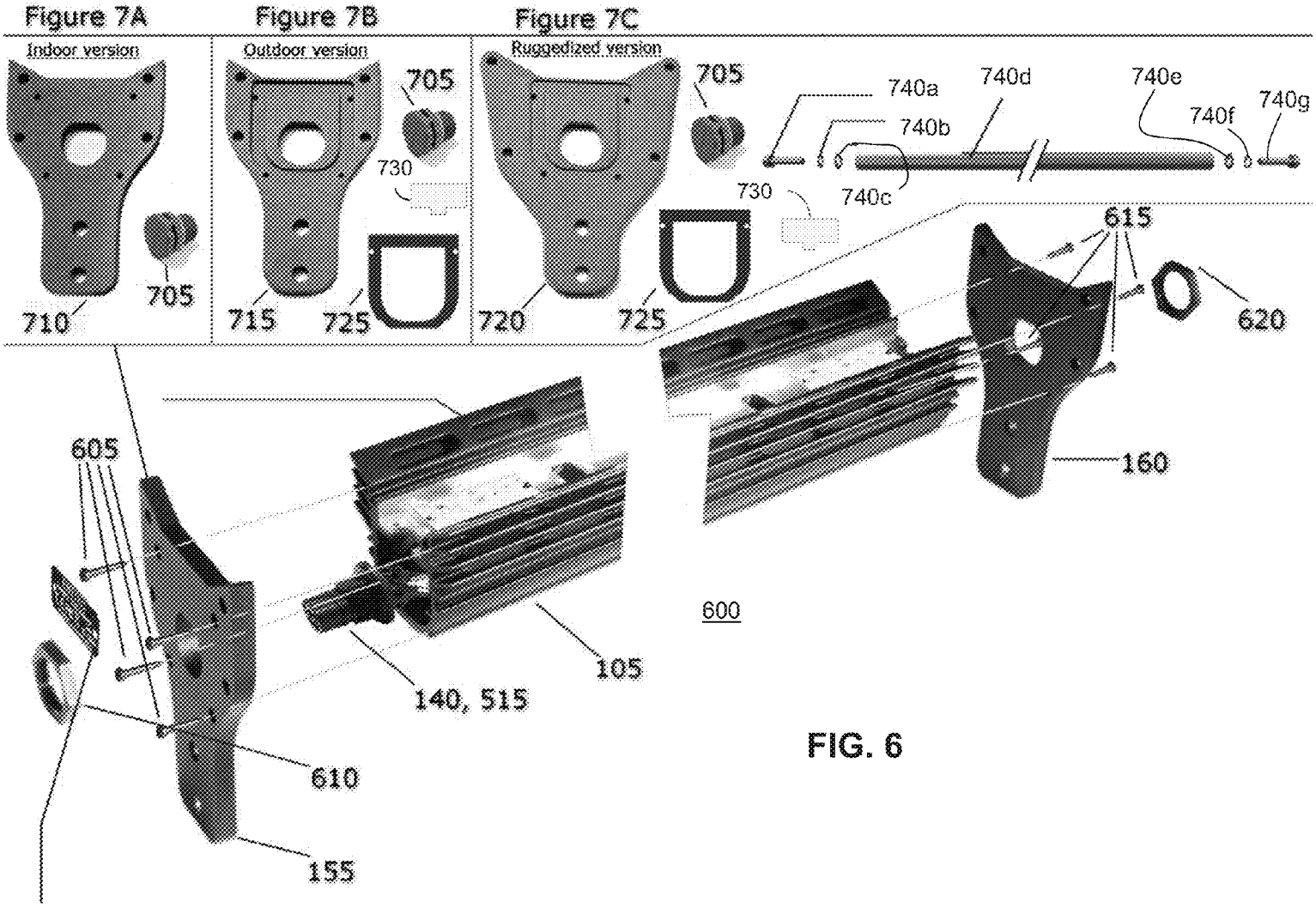
FIG. 6 is an exploded perspective view of a lighting assembly according to one exemplary embodiment.

FIG. 6 illustrates an exploded view of a lighting assembly 600 according to one exemplary embodiment. Lighting assembly 600 includes an extrusion 105, which has at least one PCB (e.g., PCB 505) located within a cavity of the extrusion and coupled to male connectors 140, 515 and female (not shown) connectors. Side plates 155, 160 are attached to extrusion 105 using screws 605 and screws 615, respectively.

Male connector 140, 515 fits through an opening in side plate 155 and is held in place using connector 610. In one exemplary embodiment, male connector 140, 515 is at least partially shaped to have screw threads and connector 610 is a nut that is screwed onto the screw threads to hold male connector 140, 515 in place.

Likewise, female connector, e.g. connector 530, fits through an opening in side plate 160 and is held in place using connector 620. In one exemplary embodiment, the female connector is at least partially shaped to have screw threads and connector 620 is a nut that is screwed onto the screw threads to hold the female connector in place.

Figure 8:
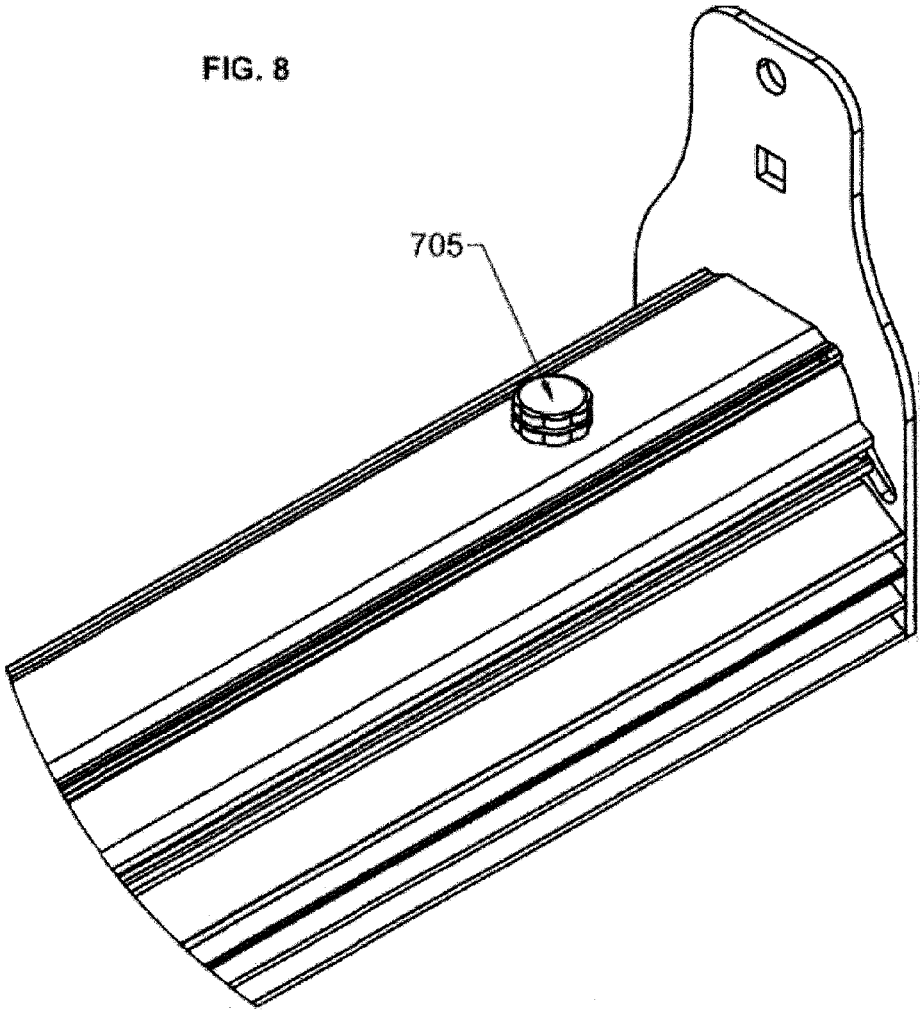
FIG. 8 is a photo illustrating a fragmentary perspective view of a valve according to one exemplary embodiment.

FIGS. 7A-7C illustrate different versions of side plates 155, 160. The side plates 710, 715, 720 of FIGS. 7A-7C can all be used in conjunction with valve 705. Valve 705 is used to release pressure as the light heats up. In one exemplary embodiment, valve 705 is located on a back portion of extrusion 105. One exemplary embodiment placing valve 705 on the assembly is shown in FIG. 8. FIG. 7A illustrates an indoor version 710 of side plates 155, 160. FIG. 7B illustrates an outdoor version 715 of side plates 155, 160. FIG. 7C illustrates a ruggedized version 720 of side plates 155, 160. The side plates 715, 720 of FIGS. 7B and 7C can be used in conjunction with gasket 725 and filler piece 730. Gasket 725 sits between the side plates and the extrusion for weatherproofing. Filler piece 730 assists in closing any gap between the side plates and the lens cover 135 to produce a weathertight seal. In one exemplary embodiment, the filler piece is made of acrylic.

Figure 9:
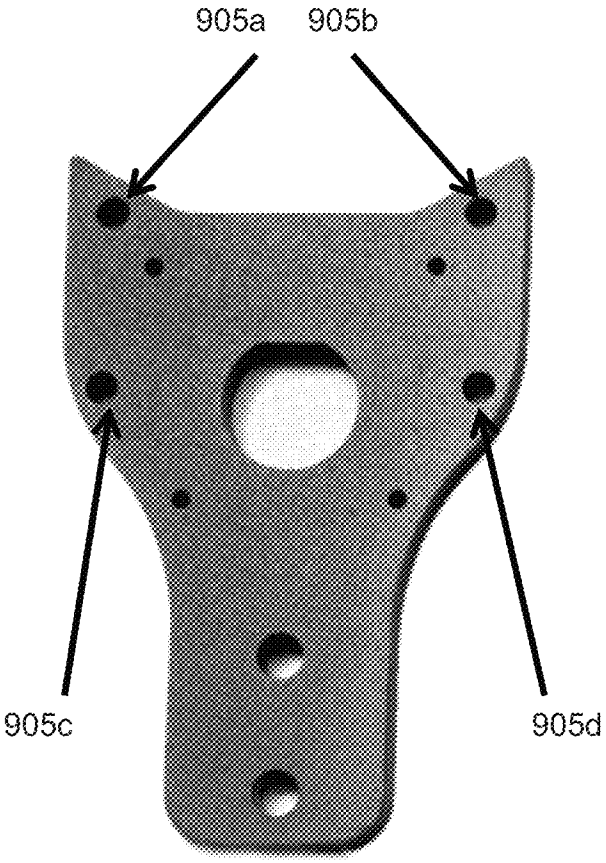
FIG. 9 is a perspective view of an indoor side plate according to one exemplary embodiment.

FIG. 9 illustrates an indoor version 710 of side plates 155, 160. There are four openings 905*a*, 905*b*, 905*c*, 905*d* on side plate 155, 160. Openings 905*a*, 905*b*, 905*c*, 905*d* accept a mechanical connector that allows for end-to-end interconnection between lighting assemblies that are adjacent. The male/female connectors, e.g., 515, 530, mate, and the four openings 905*a*, 905*b*, 905*c*, 905*d* on each adjacent plate are lined up. A connecting fastener is inserted between the openings of both units, to hold the two assemblies together and relieve strain from the electrical connection. In one embodiment, the connecting fastener is a joiner kit that comprises a rod/spacer/nut combination. Although an indoor side plate is shown in this figure, the features presented in FIG. 9 are also applicable to the side plates shown in FIGS. 7B and 7C.

The present invention, in addition to what is disclosed above, presents significant advantages. The configuration of the extrusion allows for easier facilitation of assembly. Modules (e.g., circuit board with LEDs, lens holder, and lenses) can be easily swapped in front of the heat sink and connected with control boards below through openings. The manufacturing process pushes the modules onto the electrical connection for the circuit board after lining the module and electrical connection up inside an inner chamber of the extrusion.

In addition, the present invention allows for interchangeability for different environments. A manufacturing process allows the same extrusion, LEDs, and PCBs to be used for indoor, outdoor, and ruggedized types of fixtures. The extrusion is ruggedized by using steel through-rods 740*a*-740*g* and stronger endcaps, e.g., side plates 155, 160, with gaskets, to reinforce and strengthen the chassis against vibration and shock.

The foregoing description and accompanying drawings illustrate the principles, exemplary embodiments, and modes of operation of the invention. However, the invention should not be construed as being limited to the particular embodiments discussed above. Additional variations of the embodiments discussed above will be appreciated by those skilled in the art and the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A lighting assembly, comprising:

an extrusion having:

a back plate; and a plurality of fins, each fin defining a plurality of openings, a number and a size of the plurality of openings on each fin shaped to increase heat dissipation;

at least one circuit board having a plurality of light emitting diodes;

lenses;

at least one lens holder having:

a plurality of openings; and a plurality of pockets, each of the plurality of pockets shaped to accommodate therein a corresponding one of the lenses; and when the at least one circuit board and the at least one lens holder is installed at the extrusion with the at least one lens holder placed on top of the at least one circuit board, the plurality of openings of the at least one lens holder being disposed to accommodate and surround the plurality of light emitting diodes, and the plurality of light emitting diodes being disposed and the corresponding lenses being sized and disposed in a non-linear compact footprint to maximize light density over a given area of the at least one circuit board.

2. The lighting assembly of claim 1, wherein the plurality of fins comprise top fins and bottom fins.

3. The lighting assembly of claim 2, wherein the plurality of fins allow heat to dissipate over multiple axes.

4. The lighting assembly of claim 1, wherein the back plate comprises a heat sink.

5. The lighting assembly of claim 1, wherein the back plate has a plurality of openings.

6. The lighting assembly of claim 5, further comprising a control printed circuit board, the plurality of openings of the back plate comprising a first type of opening operable to permit connection between the at least one circuit board and the control printed circuit board.

7. The lighting assembly of claim 6, wherein:

the control printed circuit board has a surface-mounted electrical connector; and the at least one circuit board is connected to the control printed circuit board through the surface-mounted electrical connector.

8. The lighting assembly of claim 5, wherein the plurality of openings of the back plate comprises a second type of opening operable to permit attachment of the at least one circuit board and the at least one lens holder to the back plate.

9. The lighting assembly of claim 1, wherein the extrusion has sides and further comprising side plates attached to each of the sides of the extrusion.

10. The lighting assembly of claim 9, wherein the lighting assembly is ruggedized by using ruggedized side plates and steel through-rods to reinforce against vibration and shock.

11. The lighting assembly of claim 1, further comprising a male connector and a female connector operable to allow serial connection of one lighting assembly to another lighting assembly.

12. The lighting assembly of claim 11, further comprising a plurality of sets each comprising the extrusion, the at least one circuit board, the lenses, the at least one lens holder, the male connector and the female connector, the plurality of sets forming a modular assembly of lighting assemblies connected to one another by respective adjacent pairs of one male connector and one female connector in a serial connection.

* * * * *